US006278354B1

(12) United States Patent
Booth

(10) Patent No.: US 6,278,354 B1
(45) Date of Patent: Aug. 21, 2001

(54) PLANAR TRANSFORMER HAVING INTEGRATED COOLING FEATURES

(75) Inventor: James Roger Booth, Cary, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/632,709

(22) Filed: Aug. 4, 2000

Related U.S. Application Data

(63) Continuation of application No. 09/053,790, filed on Apr. 2, 1998, now Pat. No. 6,144,276.

(51) Int. Cl.[7] ..... H01F 5/00; H01F 27/08

(52) U.S. Cl. ..... 336/200; 336/60; 336/61; 336/223; 336/232

(58) Field of Search ..... 336/60, 61, 200, 336/232, 83; 29/606, 602.1

(56) References Cited

U.S. PATENT DOCUMENTS 5,495,213 * 2/1996 Ikeda ..... 336/223

* cited by examiner

*Primary Examiner*—Anh Mai
(74) *Attorney, Agent, or Firm*—Scott M. Garrett

(57) ABSTRACT

A planar electromagnetic device, such as a planar transformer or planar inductor, is provided with features for cooling that are formed integrally with the windings of the planar device. In a preferred embodiment the planar device uses winding layers (200) having fin portions (116). In a first alternative embodiment a helical winding (500) is formed from a winding stamping (400) having fin portions (412). In a second alternative embodiment, tube portions (802) are formed in a winding stamping (700) used to form a helical winding.

12 Claims, 4 Drawing Sheets

PLANAR TRANSFORMER HAVING INTEGRATED COOLING FEATURES

CROSS REFERENCE TO RELATED APPLICATIONS

This is a continuation of application Ser. No. 09/053,790, filed Apr. 2, 1998, U.S. Pat. No. 6,144,276 and assigned to Motorola, Inc.

TECHNICAL FIELD

This invention relates in general to planar electromagnetic devices such as planar transformers, and more particularly to means for cooling planar electromagnetic devices.

BACKGROUND

Planar transformers and planar inductors are used in a wide variety of products, and are typically used when the space available within a given product or device does not allow for placement of a conventional wire wound transformer. In general, planar transformers have a lower profile than conventional transformers for similar electromagnetic performance, and can thus be used in low profile product enclosures or packages where height restrictions prohibit the use of conventional transformers. Planar transformers and planar inductor achieve the necessary performance in low profile assemblies by using spiral windings.

Spiral windings are comprised of a conductor disposed on a flat substrate, such as, for example, a printed circuit board. In many applications spiral windings are stacked on a circuit board, with each winding on a separate layer. In making a planar inductor, the spiral windings are electrically coupled in series such that current through the windings flows in the same direction through each spiral. Meaning that if current is flowing in a clockwise direction, for example, it flows in a clockwise direction through each spiral conductor in connected in series to make an inductor or transformer winding. When the current reverses direction, the current flows in a counter clockwise direction through each spiral conductor, so as have an additive effect on the magnetic field produced by the current through each spiral conductor. In making a planar transformer, selected windings are electrically coupled in series to form primary and secondary windings, each comprising at least one spiral conductor. Typically the winding layers of the primary and secondary windings are interleaved to optimize electromagnetic performance. Once the winding layers are configured as needed, a core is placed around the windings to contain the magnetic field of the windings. In conventional planar inductors and transformers, the core completely covers the windings to capture the most magnetic flux possible.

The fact that the core completely covers the spiral conductor windings presents a problem. In planar devices used for power applications, such as power supplies, heat generated by the current through the windings becomes significant, and degrades the performance of the core and winding(s), and thus degrades the performance of the transformer or inductor. Unlike conventional bobbin style transformers, because spiral windings in conventional planar transformers or planar inductors are covered by the core and other winding layers, cooling the planar electromagnetic device is a significant issue.

A conventional technique for cooling the planar device is the use of a fan. However, this obviously adds expense and complexity to the product in which the planar device is used. Furthermore, while a fan can significantly cool the outer portions of the planar device, the internal regions will likely remain at high temperatures. Therefore there exists a need for a means by which a planar transformer or planar inductor can be efficiently cooled without the use of a fan, and such that the internal regions of the planar device will benefit.

DETAILED DESCRIPTION OF THE PREFERRED EMBODIMENT

Figure 1:
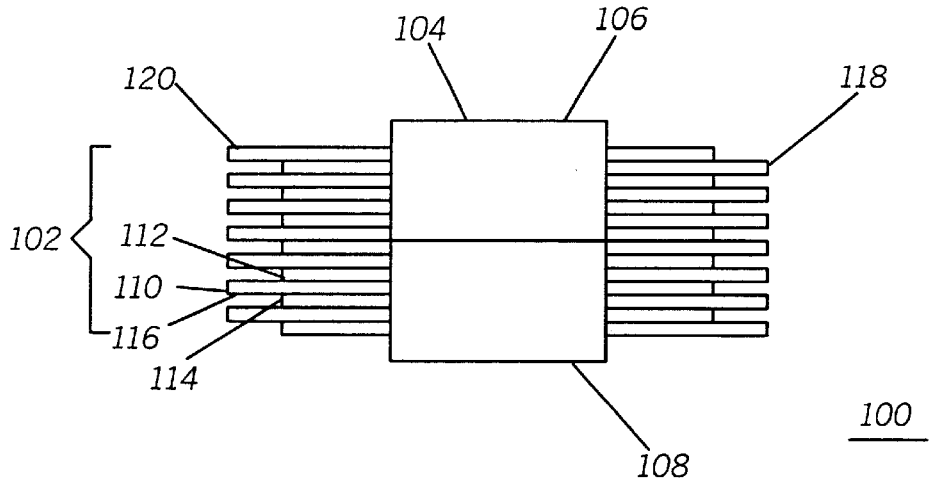
FIG. 1 shows a side elevational view of a planar electromagnetic device in accordance with the invention.

While the specification concludes with claims defining the features of the invention that are regarded as novel, it is believed that the invention will be better understood from a consideration of the following description in conjunction with the drawing figures, in which like reference numerals are carried forward.

The invention solves the problem of cooling a planar electromagnetic device such as a planar transformer or planar inductor by forming the windings or winding layers in such a way as to significantly increase the conduction of heat from the inner regions of the planar electromagnetic device to the outer regions, and further provides features for dissipating heat through convection enhancing features integrally formed on the winding or winding layers. Specifically, in a first embodiment, fin portions are formed on alternate winding layers of a stack of winding layers. The conductor winding disposed on the winding layer has a portion extending out onto the fin portion of the winding layer, thus making the conductor winding itself the means by which heat is conducted out of the planar device. By providing fin portions on alternate layers, the portion of the conductor winding disposed on the fin portion may be in direct contact with the air, providing a means for dissipating heat into the air. In a first alternative embodiment, a helical winding is used in place of individual winding layers. The helical winding is formed from a winding stamping. Sections of the winding stamping have features that, upon folding the winding stamping into a helical winding, form fin portions for cooling the planar device. In a second alternative embodiment, also using a helical winding, the folded portions of the winding stamping are folded around forming tools, such as rods, to form tube portions for cooling the planar device.

Figure 2:
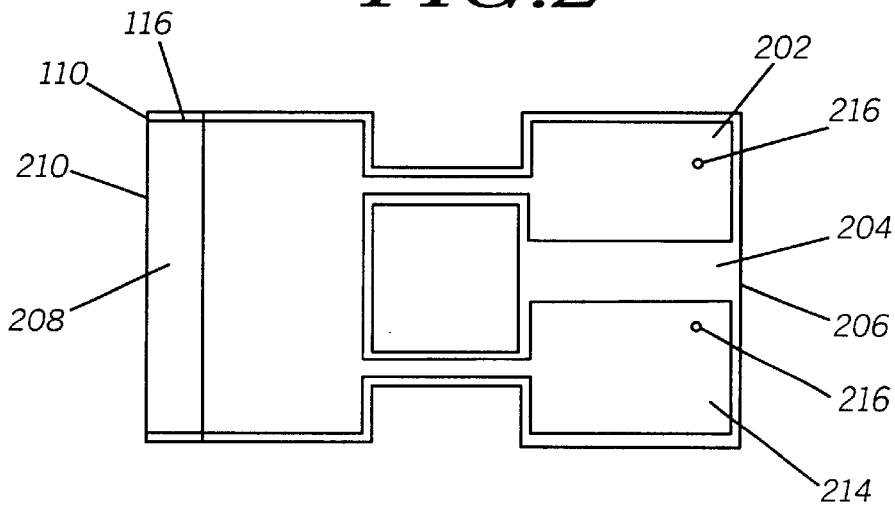
FIG. 2 shows a top plan view of a winding layer in accordance with the invention.
Figure 3:
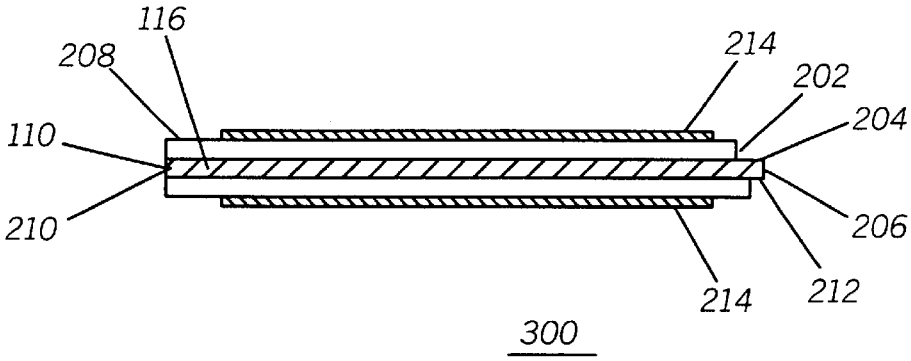
FIG. 3 shows a side cross sectional view of a winding layer in accordance with the invention.

Referring now to FIGS. 1, 2, and 3, there is shown a side elevational view of a planar electromagnetic device 100, a top plan view of a winding layer 200, and a side cross sectional view of a winding layer 300, respectively, and all in accordance with the invention. The planar electromagnetic device may be a planar transformer or a planar inductor or choke, and comprises a plurality of winding layers 102, and a core 104. The core is a conventional core, such as an E shaped ferrite core comprised of a first half 106 and a second half 108, as is well known in the art. At least one winding layer, such as winding layer 110, of the plurality of winding layers is disposed between an upper adjacent layer 112 and a lower adjacent layer 114 and has a fin portion 116 extending beyond the upper and lower adjacent layers. The winding layer has a conductor winding 202 disposed on a first side 204 of a dielectric substrate 206. The conductor winding is a spiral winding comprised of metalization disposed on the dielectric substrate, and in the embodiment shown, the spiral winding is a substantially U shaped winding constituting a single turn. A portion 208 of the conductor winding extends onto the fin portion of the winding layer, and may be coterminal with an edge 210 of the dielectric substrate. In the preferred embodiment, a conductor winding is also disposed on second side 212 of the dielectric substrate. As the winding layers are stacked, it is necessary, when conductor windings are present on both sides of the dielectric substrate, to provide an insulator layer 214 on top of the conductor windings to prevent electrical contact between adjacent winding layers. However, it is preferred that the portion of the conductor winding disposed on the fin portion 116 is not insulated, but exposed. As can be seen in the winding layer shown in FIGS. 2 and 3, the metalization used to form the conductor winding is preferably over a majority of the dielectric substrate. This metalization conducts heat out of the internal regions of the planar device to the fin portion where heat is dissipated into the ambient atmosphere.

In a preferred embodiment, the winding layers are staggered on opposite sides, as shown in FIG. 1. Specifically, a first set of alternate layers has fin portions on a first side 118 of the planar device while a second set of alternate layers has fin portions on a second side 120 of the planar device. The first and second sets of alternate layers are interleaved so that each winding layer has a fin portion exposed to the ambient atmosphere to maximize the cooling effect of the fin portions. To further enhance the cooling effect of the fin portions, it is contemplated that the dielectric substrate is Aluminum Nitride, which is known to be an excellent thermal conductor compared to other dielectric materials of similar cost.

If planar device is to be an inductor, the plurality of winding layers are electrically connected in series. If it is to be a transformer, then certain winding layers are selected for a primary winding and are electrically connected in series, and other winding layers are selected for a secondary winding and are electrically connected in series. The winding layers may be electrically connected by conventional means, such as, for example, plated vias 216, or by the use of conductive posts passing through the layers, as is known in the art.

Figure 4:
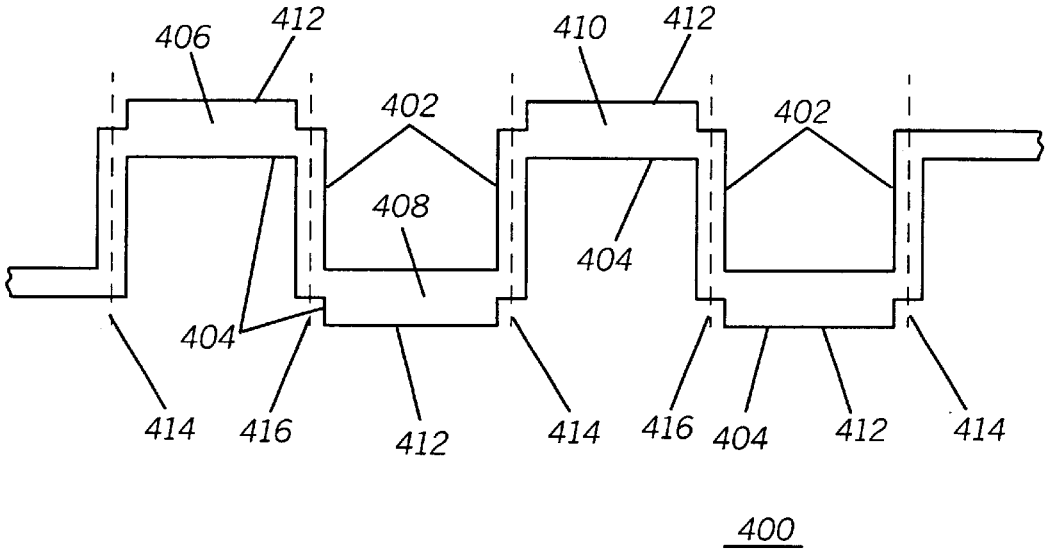
FIG. 4 shows a winding stamping in accordance with a first alternative embodiment of the invention.
Figure 5:
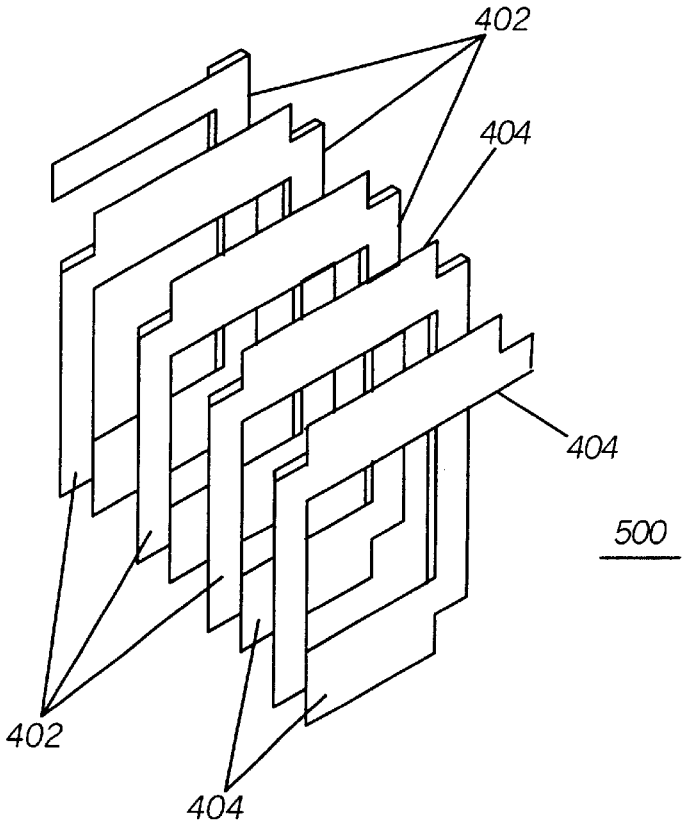
FIG. 5 shows a helical winding in accordance with a first alternative embodiment of the invention.

Referring now to FIGS. 4 and 5, there is shown a segment of a winding stamping 400 and a segment of a helical winding 500, respectively, and both in accordance with a first alternative embodiment of the invention. The helical winding 500 is formed by folding the winding stamping 400 in a prescribed format. The winding stamping is a laminate having a sufficiently thin conductor layer and insulator layers on both sides of the conductor layer, except as will be described hereinbelow. The winding stamping may be formed, for example, from a sheet of insulated metal, or it may be a flex circuit, both of which are known in the art. The conductor is preferably copper, but it is contemplated that other conductors may be used with similar results.

The winding stamping comprises parallel fold portions 402 and alternating connector portions 404 joining the parallel fold portions at alternating ends. By alternating ends it is meant that the alternating connector portions join the parallel fold portions, for example, by a top connector portion 406, then a bottom connector portion 408, then a second top connector portion 410, and so on, alternating between top then bottom. The alternating connector portions also comprise cooling portions, such as fin portions 412 that extend outward and are formed contiguously with the alternating connector portions. A helical winding 500 is formed from the winding stamping by folding at the parallel fold portions in an accordion fashion. The folds are along the dashed lines 414 and the dotted lines 416. The different lines represent folds in different directions, alternating between a fold in a first direction (into the page) and a fold in the opposite direction (out of the page).

Figure 6:
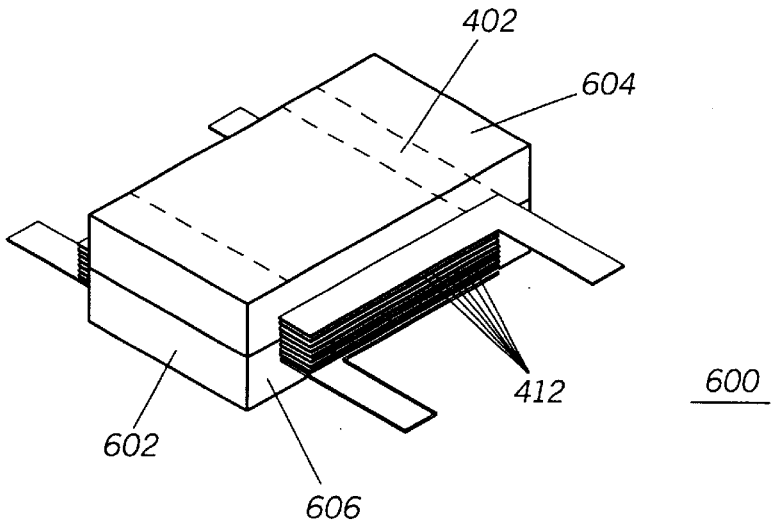
FIG. 6 shows an isometric view of a planar transformer in accordance with a first alternative embodiment of the invention.

Referring now to FIG. 6, there is shown an isometric view of a planar transformer 600 in accordance with a first alternative embodiment of the invention. The planar transformer is formed by two helical windings as illustrated in FIG. 5 that are interleaved. In an inductor is needed, only one helical winding is used. The fin portions 412 of the helical winding extend outwards from the structure to cool the planar device, much the same as the stacked planar device illustrated in FIG. 1. A core 602 is placed over the helical windings, and is preferably an E shaped core, as is known in the art, comprised of an upper half 604 and a lower half 606. The folded parallel portions 402 are hidden, and pass between the halves of the core. Since the folded portions, after being folded, are twice as thick as the fin portions 412, there will be air gaps between adjacent fin portions, facilitating the convection of heat into the ambient atmosphere. It is contemplated that the fin portions may be insulated on only a first side, leaving the conductor on a second side exposed and in direct contact with the ambient atmosphere.

Figure 7:
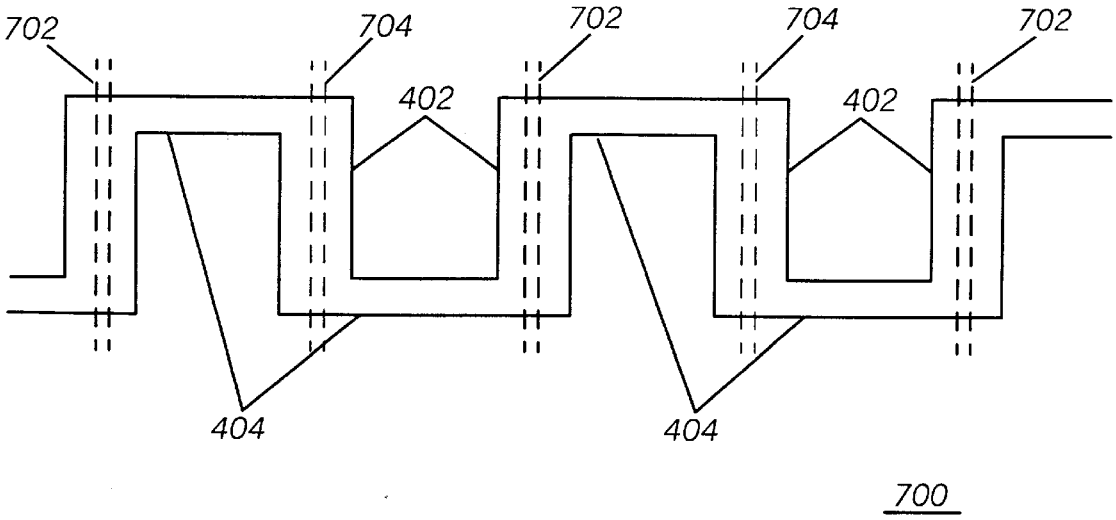
FIG. 7 shows a winding stamping in accordance with a second alternative embodiment of the invention.
Figure 8:
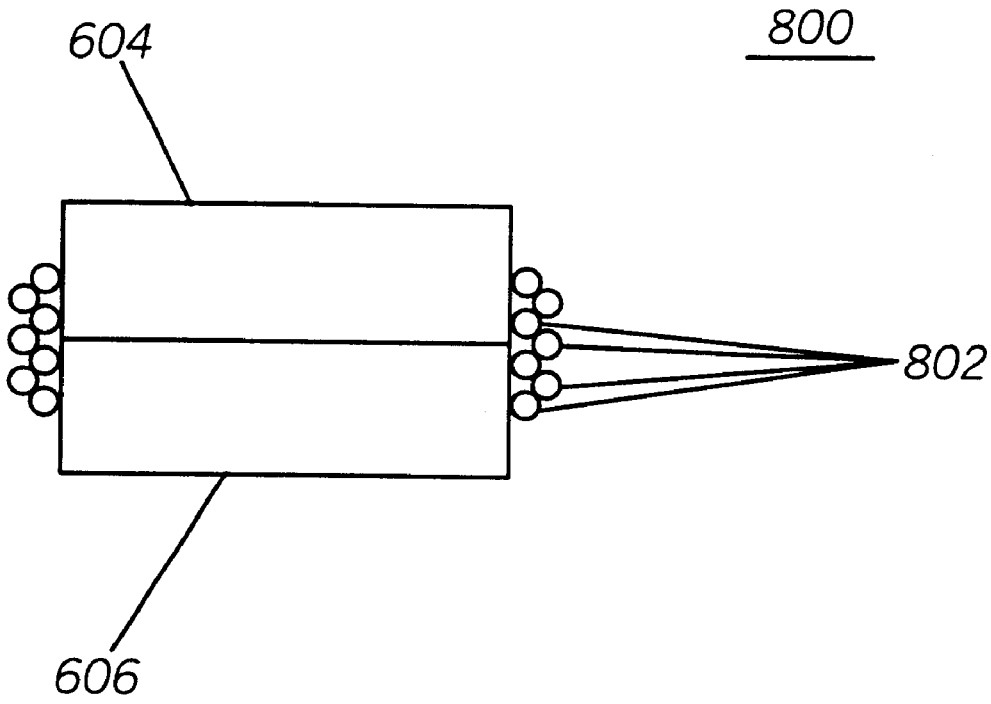
FIG. 8 shows a side elevational view of a planar electromagnetic device in accordance with a second alternative embodiment of the invention.

Referring now to FIGS. 7 and 8, there is shown therein a winding stamping 700 and a side elevational view of a planar electromagnetic device 800, respectively, and both in accordance with a second alternative embodiment of the invention. The winding stamping 700, as with the winding stamping of FIG. 4, includes parallel fold portions 402 and alternating connector portions 404. However, here the fold portions will form the cooling portions. The parallel fold portions of a winding stamping made in accordance with this second alternative embodiment of the invention are wider than those of the winding stamping of FIG. 4, and are folded around a substantially rod shaped member, as indicated by the double fold lines in FIG. 7, to form tube portions 802. The core 604 and 606, instead of being placed over the fold portions, is placed over the connecting portions, leaving the tube portions outside of the core. Heat is dissipated through convection in the tube portions, conducted to the tube portions by the connecting portions.

Thus, the invention provides for a means by which heat can be efficiently conducted out of the internal regions of a planar electromagnetic device by using the metalization layer of the winding in conjunction with integrally formed cooling features for dissipating heat by convection to the ambient atmosphere. However, instead of being a simple heat sink, the heat conducting portions also contribute to the electromagnetic function of the planar device by carrying current. The performance under load conditions is significantly improved since the core and conductors can be kept cooler than a conventional planar device of similar performance.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A planar electromagnetic device, comprising:

a stack of individual winding layers, each of the winding layers comprising a dielectric substrate, a conductor winding disposed on the substrate;

means for electrically connecting the winding layers;

at least one of the winding layers being disposed between an upper adjacent layer and a lower adjacent layer and having a fin portion extending beyond the upper and lower adjacent layers, a portion of the conductor winding extending onto the fin portion for conducting heat out of an internal region of the planar electromagnetic device and dissipating the heat into an ambient atmosphere; and a magnetic core disposed around a central portion of the stack of winding layers.

2. A planar electromagnetic device as defined in claim 1, wherein the portion of the conductor winding disposed on the fin portion is exposed.

3. A planar electromagnetic device as defined in claim 1, wherein the dielectric substrate is aluminum nitride.

4. A planar electromagnetic device as defined in claim 1, wherein the portion of the conductor winding disposed on the fin portion is coterminal with the dielectric substrate at an edge of the fin portion.

5. A planar electromagnetic device as defined in claim 1, wherein the planar electromagnetic device is an inductor, the winding layers are electrically connected in series.

6. A planar electromagnetic device as defined in claim 1, wherein the planar electromagnetic device is a transformer, the winding layers comprising a primary winding and a secondary winding.

7. A planar electromagnetic device having integrated cooling features, comprising:

a stack of individual winding layers, each of the winding layers comprised of a dielectric substrate and a conductor winding disposed on the dielectric substrate;

means for electrically connecting the winding layers;

the stack of individual winding layers comprising a first set of alternate layers and a second set of alternate layers, the alternate layers of the first and second set of alternate layers being interleaved; and each winding layer of the first set of alternate layers having a fin portion extending beyond the winding layers of the second set of alternate layers at a first side of the planar electromagnetic device, the conductor winding of each of the winding layers of the first alternate set of winding layers extending onto the fin portion of the winding layer for conducting heat out of an internal region of the planar electromagnetic device and dissipating the heat into an ambient atmosphere.

8. A planar electromagnetic device as defined in claim 7, wherein each winding layer of the second set of alternate layers having a fin portion extending beyond the winding layers of the first set of alternate layers at a second side of the planar transformer.

9. A planar electromagnetic device as defined in claim 7, wherein the portion of the conductor winding extending onto the fin portion is exposed.

10. A planar electromagnetic device as defined in claim 7, wherein the dielectric substrate is aluminum nitride.

11. A planar electromagnetic device as defined in claim 7, wherein the portion of the conductor winding extending onto the fin portion is coterminal with the dielectric substrate at an edge of the fin portion.

12. A planar electromagnetic device as defined in claim 7, wherein the planar electromagnetic device is an inductor comprising a single helical winding.

* * * * *